United States Patent [19]

Moessinger et al.

[11] Patent Number: 4,589,451

[45] Date of Patent: May 20, 1986

[54] WEFT MEASURING DEVICE FOR WEAVING LOOM

[75] Inventors: Albert Moessinger, Epalinges, Switzerland; Joël Angebault, Riedisheim, France

[73] Assignee: Societe Alsacienne de Construction de Material Textile, Mulhouse, France

[21] Appl. No.: 635,740

[22] Filed: Jul. 30, 1984

[30] Foreign Application Priority Data

Aug. 2, 1983 [FR] France ..... 83 12931

[51] Int. Cl.[4] ..... D03D 47/34

[52] U.S. Cl. ..... 139/452

[58] Field of Search ..... 139/443, 450, 452

[56] References Cited

U.S. PATENT DOCUMENTS 3,393,709 7/1968 Brugg .
3,833,028 9/1974 Chattaway et al. .
4,509,563 4/1985 Gosciniak et al. ..... 139/443

FOREIGN PATENT DOCUMENTS 1492449 7/1967 France .
2324776 4/1977 France .
2445865 8/1980 France .

*Primary Examiner*—Henry S. Jaudon
*Attorney, Agent, or Firm*—Parkhurst & Oliff

[57] ABSTRACT

Weft measuring device for weaving looms, and in particular for shuttleless looms where the weft is cast through a shed by a pressurized mechanism or by the energy communicated to the mass of the yarn by a casting mechanism. The device has a pair of propelling rollers driven in rotation which form a gripping line between which the weft yarn is introduced intermittently by way of elements actuated in relation to the weft casting program. At least one of the rollers has a structure such that the end of the gripping line toward which the yarn is conveyed at the start of measurement moves regularly and synchronously with the cycle of the loom.

14 Claims, 9 Drawing Figures

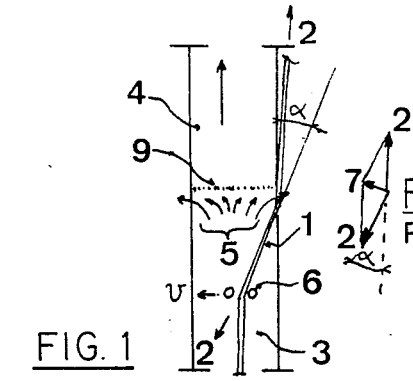
FIG. 1
PRIOR ART
FIG. 1a
PRIOR ART
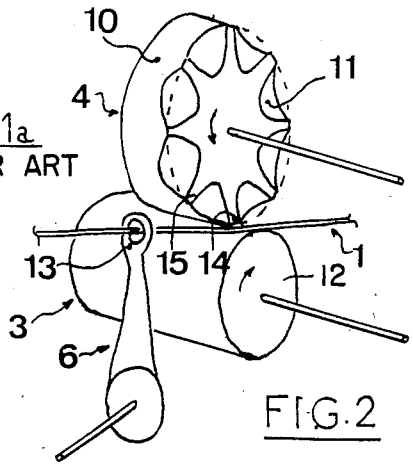
FIG. 2
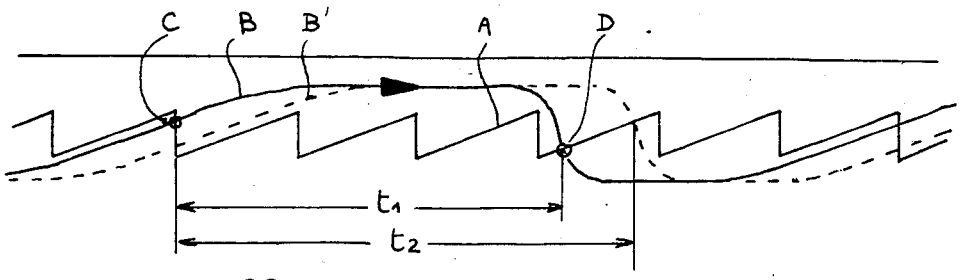
FIG. 4
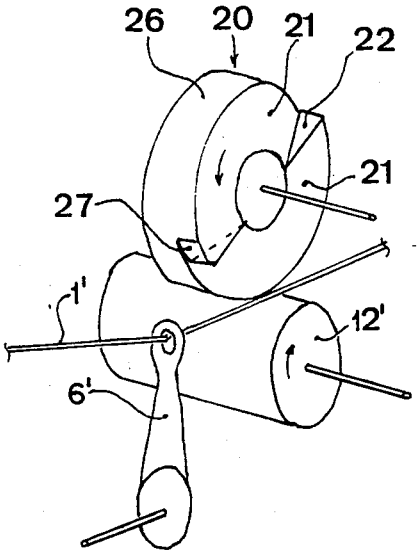
FIG. 3

WEFT MEASURING DEVICE FOR WEAVING LOOM

BACKGROUND OF THE INVENTION

The present invention relates to an improvement in weft measuring devices used in shuttleless looms, and in particular to feeding-measuring devices feeding weft yarns to a storage chamber used for temporarily storing a predetermined length of weft yarns before the yarn is cast into the shed.

Shuttleless looms, and in particular those looms in which the weft is cast through the shed by pressurized means (air jet, or water jet), or by the energy communicated to the mass of the yarn itself, are all equipped with a measuring device which permits the length of the picks to be determined as exactly as possible, particularly in order to reduce wastes due to the yarn coming out on the sides of the formd fabric. Such measuring devices should also be usable for yarns liable to have different characteristics, which is particularly the case in multi-pick looms where yarn measuring is intermittent.

The measuring devices proposed up to now can be divided into two major classes (1): the drum measuring devices where the length is determined by a number of spires, and (2) the unwinding measuring devices where the yarn is squeezed between two rotating rollers. The first devices, which, mechanically, are more complicated, are quite accurate, whereas the second type, although simpler in design, lack accuracy and are difficult to use on multi-pick looms where different types of yarns are cast at a very specific rate.

This disadvantage is explained by the structure of these measuring devices and by the way they work. Indeed, the length of the yarn in these measuring devices is determined either by an intermittent clearance between the rollers, or by the temporary introduction of the yarn between the rollers which are then held in permanent contact. The accuracy of the measurement by successive clearances between the rollers is independent of the thickness of the yarn, which may be variable, and of its coefficient of friction on the rollers, which may vary in relation to the orientation of the fibers. Moreover, and especially when working at high speeds, the movable roller may bounce on the driving roller, giving an erroneous measurement of the length of the yarns.

In the measuring devices where the rollers are kept in permanent contact, inaccuracy is due to a number of damaging factors present mainly when the yarn penetrates between the rollers. To help this penetration, it has been proposed to provide a slight peripheral chamfer as described in U.S. Pat. No. 3,833,028. But the effect, in this case, is similar to that of the two surfaces coming closer together in the case of a system of rollers with temporary clearance between the rollers, and as such it has the same disadvantages as those indicated above, especially when yarns of different natures and possibly of different thickness, are alternately worked. Another problem which arises with this type of measuring device is the disturbing effect produced by the air stream created by the rotation of the rollers when the yarn is introduced between them. Indeed, the surface of the casings of the rollers carries a fine layer of air or limit layer at its peripheral speed, which air cannot therefore go through the gripping line and escapes laterally, thus tending to push the yarn back when it is introduced between the rollers.

Finally, the adjustment of this type of measuring device in relation to the width of the fabric to be produced (modification of weaving width) is difficult.

It has also been proposed (French Pat. No. 1 492 449), in another field than weaving, namely in the spinning field, to use a yarn feeding device comprising two rotating rollers, one driving, the other pressing. In this device the pressing roller is split on one of its edges in order to transport the yarn from the repair plane (knotting) to the plane where the yarn is squeezed between the rollers.

Such a solution, however, is not transposable to the measuring devices used on looms as it does not permit synchronization with the weaving cycle.

SUMMARY OF THE INVENTION

It is the object of the present invention to overcome the aforesaid drawbacks and to propose a measuring device of the type whereby the rollers are permanently in contact (i.e., the rollers are not raised up to stop the output of the machine), and which permits not only an accurate measurement of the pick to be cast, but can be used on multicolor looms, this being quite impossible before the present of apparatus. The device according to the present invention also is very easy to adjust, especially when it is requred to modify the length of the measured yarn, for example, when modifying the weaving width.

In the following description, the wording "permanent contact" should not be given its strict meaning. It should be interpreted to include a situation where a slight clearance, less than the diameter of the yarn to be measured, exists between the rollers. Of course, when there is a clearance between the rollers, the rollers are driven positively.

In general, the invention relates to a weft measuring device for weaving looms, and more particularly for shuttleless looms where the weft is cast through the shed by pressurized means or by the energy communicated to the mass of the yarn by a casting mechanism. The device according to the present invention type comprises a pair of propelling rollers permanently driven in rotation. The casings of the rollers form a gripping line between which the weft yarn is introduced intermittently by way of elements actuated in relation to the weft casting program, characterized by the fact that at least one of the rollers has a structure such that the end of the gripping line towards which the yarn is conveyed, at the start of measurement, moves regularly and sychronously with the cycle of the loom.

The length of the gripping line varies cyclically and is obtained in different ways, for example, by providing a notch or alveolus on at least one side of one of the rollers.

According to one embodiment of the invention, it is possible to introduce the weft yarn between the measuring rollers with great accuracy and to use one and the same measuring device for yarns of different trees. Indeed, while the gripping line is becoming shorter, the yarn, under the action of guiding means, is moved without obstacle on the other rollers. When the gripping line lengthens, the yarn will be caught under it.

The roller, whose structure is such that the length of the gripping line can be caused to vary synchronously with the cycle of the loom, thus permitting measurement, is hereinafter designated as a "notched roller".

When the variation in the length of the gripping line is rapid, for example, when the roller comprises a very large number of successive notches on one of its sides, it is possible to operate it without having to see that it is synchronized with the cycle of the looom. Since the synchronism is automatic.

On the other hand, when the variation in the gripping line takes place over a rather long period, for example, over half-a-rotation of the roller in the case of notches having the form of two symmetrically-cut faces, it is necessary to synchronize the roller with the cycle of the loom. This is obtained mechanically by providing notches on the driving roller such that the variation in the length of the gripping line occurs at a specific position synchronously with the cycle of the loom.

The end of the gripping line may move either at the same speed in one direction and in the other, or faster in one direction than in the other. Such speed variation may be obtained by the notch (or alveolus) being given a non-symmetrical shape. In a a preferred embodiment, the displacement is slow towards the inside (reduction of the gripping line) and fast towards the outside (increase of the gripping line). Thus, the starting of the yarn can be very accurate.

Moreover, the guiding element permitting insertion of the yarn between the rollers may also move more rapidly in one direction than in the other. This movement will be conjugated with the movement of the end of the gripping line.

Finally, it is possible to vary the length of the measured yarn to a certain extent. This is obtained by shifting the notched roller at an angle with respect to the movement of the guiding element.

BRIEF DESCRIPTION OF THE DRAWINGS

The present invention will be more readily understood by reading the following description with reference to the accompanying drawings in which:

FIGS. 1 and 1*a* are diagrammatical perspective views showing the active forces exerted during the penetration of the yarn between the rollers of a measuring device according to the prior art;

FIG. 2 is a perspective view of a measuring device according to the present invention in which one of the rollers comprises a plurality of alveoli of symmetrical shape permitting to periodical variation of the length of the gripping line between the rollers;

FIG. 3 is a perspective view of another embodiment according to the present invention comprising two symmetrical alveoli in the form of cut faces;

FIG. 4 is a time/path diagram of the movement of the end of the gripping lines and of the movement of the yarn guiding element;

DETAILED DESCRIPTION OF THE PREFERRED EMBODIMENTS

Figure 5:
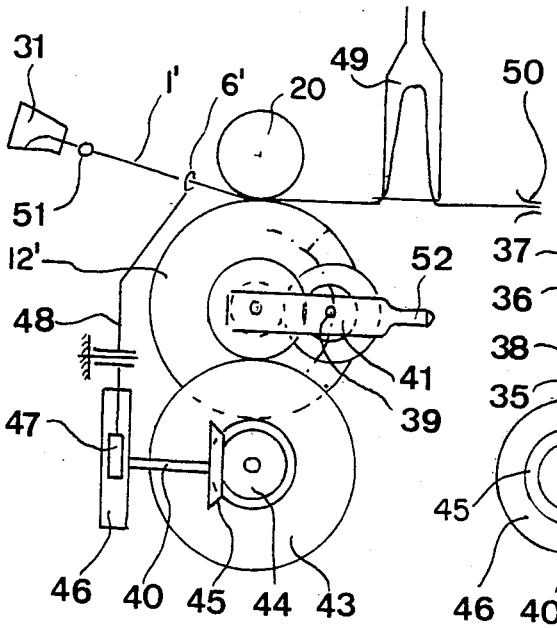
FIG. 5 is a side view and FIG. 6 is a plan view illustrating the use of a measuring device according to the invention, and more particularly of the device illustrated in FIG. 3, on a weaving loom, as well as the means permitting variation of the length of the yarn by angularly shifting the notched roller.

Referring now to the accompanying drawings and more particularly to FIGS. 1 and 1*a*, in order to measure a predetermined length thereof the yarn (1) is subjected to a tension (2) caused by any appropriate means such as, for example, a stream of air, using a measuring device constituted by two rollers (3,4) with the yarn being introduced therebetween by way of movable guiding means (6). The guiding means (6) should stop the yarn at the end of the gripping line (9) and in a position forming an angle $\alpha$ which increases gradually until the resultant force (7) of the forces (2) balances the resistance to penetration (FIG. 1*a*). This resistance varies with the size, i.e., thickness, texture, and pliability of the yarn. One of the components of this resistance is formed by a stream of air coming out from both sides of the rollers (3,4) in front of the gripping line (9). The movement of rollers (3,4) carries a layer of air which, when reaching towards the obstacle created by the gripping line (9), follows the direction represented by arrows (5). The yarn (1) held at the lateral interstice between the rollers (3,4) is pushed against by the air as a result of its thrusting force, causing the angle $\alpha$ to increase or decrease, which more or less delays the gripping of the yarn.

Tests show that angle $\alpha$ varies. As a result, at the speeds currently used around 40 M/sec., a small variation in $\alpha$ corresponds to great differences in measured length, of about 5 to 10 cm. Also, with such a device it is difficult to introduce yarns of a different nature, as used with multicolor looms.

These disadvantages are all overcome with the device according to the invention.

According to an embodiment illustrated in FIG. 2, the measuring device comprises two rotating rollers (10,12). One of them, (10) has on one of its faces a plurality of alveoli (11) in the shape of concave depressions located along its periphery. The alveoli (11) thus enable modification of the length of a gripping line between roller (10) and roller (12). A projecting part (14) of the roller (10) defines the gripping line upon coming in contact with the roller (12). The number of alveoli determines the number of projection parts (14) on the roller (10). Therefore, if the number of alveoli is changed thereby, changing the number of projections (14), the distance between two succeeding gripping lines is also changed. Thus, roller (10) operates to facilitate the insertion of the yarn between the rollers (10,12). Indeed, the gripping line will be shorter at the passage of alveolus (11), thus placing it away from the yarn which is then held in position by the projecting part (14) and allowing the stream of air to disperse without influencing the yarn. The yarn (1) can, under the action of guiding element (13), penetrate intermittently between the rollers (11,12) until the arrival of a projecting part (15) which will squeeze the yarn during its transversal movement in contact with the periphery of the roller (12). By properly shaping the alveoli the speed with which the guiding line is shortened and lengthened can be controlled, e.g., so that it shortens slowly and lengthens quickly.

FIGS. 3,4,5 and 6 illustrate the structure and working of a measuring device according to the invention in which, in addition to a correct measurement, the device regulates the measured length of the yarn.

In this embodiment comprising two rotating rollers (20, 12') one side of roller (20) comprises a plurality of cut faces (21), essentially formed by two helical surfaces joined together via substantially axial planes (22). The roller (20) forms, with roller (12'), a gripping line of variable length represented on the time/path diagram in FIG. 4 by zig-zag line "A". Each zig-zag in the line corresponds to a half turn of the roller (20). A guiding means (6') moves the yarn (1') tangentially or causes it to pass over roller (12'). The guiding means (6') follows the helical surface (21) without penetrating between the rollers. The yarn (1') is squeezed in the gripping line defined by the roller (20) coming in contact with the roller (12'), as indicated at point "C" in FIG. 4, with each zig-zag portion of FIG. 4 corresponding to a half-turn of the roller (20). This movement is illustrated in FIG. 4 by the curve "B". The measurement of the yarn begins when axial plane (22) comes into contact with rollers, (12') as shown at point "C" and ends when guiding element (6') brings the yarn (1') out of the gripping line (at point "D").

By shifting movement "A" with respect to B or vice-versa (dotted line B'), measuring time t is changed, as a result the measured length also is changed. In order to repeat the measurement, it is advised to synchronize the speed of rotation of the notched roller (20) of the measuring device with that of the loom, such that for every complete cycle of the loom the roller (20) rotates a complete cycle. In other words, if the roller (20) has only one aleveolus, then the roller (20) should complete its cycle in synchronization with the cycle of the loom. Similarly, if the roller (20) has two alevoli, then the roller (20) should complete half of its cycle in synchronization with complete cycle of the loom. Therefore, the number of rotations of the notched roller for every rotation of the loom has to be 1/N, N being the number of alveoli so arranged as to follow an angularly equal distribution. In the example shown in FIG. 2, roller (10) has eight alveoli and therefore should turn at $\frac{1}{8}$, . . . $\frac{5}{8}$, . . . 15/8 rotations of the looms.

Figure 6:
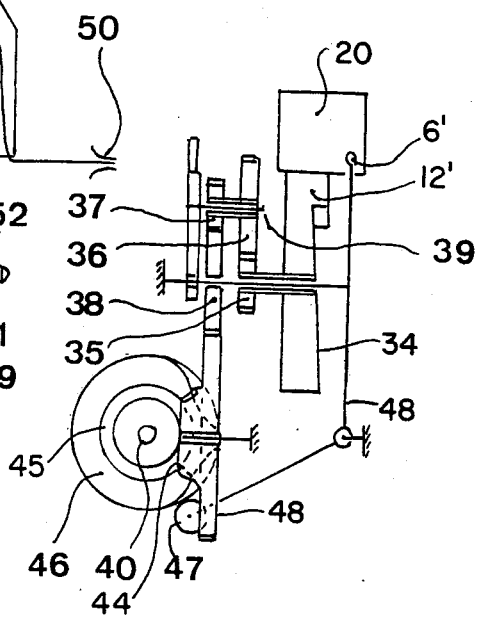

The device may be adapted, as shown in FIGS. 5 and 6, so as to deliberately offset the movements between roller (20) and guiding element (6') in order to vary the length of the measured yarn, thus permitting normal modification of the weaving width without having to change the speed of the measuring device.

Such offsetting is obtained as illustrated in FIGS. 5–6.

Referring to FIGS. 5 and 6, a yarn (1') is pulled from a bobbin (31) and passes through a guiding element (6'). While waiting, the yarn (1') passes on roller (33) outside the gripping line between rollers (10') and (12'). A storage (49) of conventional type, formed by a flat tube inside which a stream of air is created, stores the yarn delivered by the measuring device before it is cast into a shed (not shown) by any suitable casting means such as a pneumatic nozzle (50). A brake (51) with a variable braking pressure and controlled with the rhythm of the loom is inserted between bobbin (31) and guiding element (6').

The notched roller (12') is mounted for rotation with a toothed pinion (35) the roller (12') is driven by satellite pinions (36,37) mounted on and turning about a common shaft (39) fixed on a support (41) having a handle 52, and being movable about pinions (35) and (38).

The pinion (38) is coaxial with pinion (35) and is connected to the shaft (40) of the loom by a gear (43) and by a couple of conical gears (44,45). A cam (46) is keyed on shaft (40) of the loom acts on a wheel (47) and the lever (48) of guiding element (32). By moving handle (52) of the support (41), it is possible to offset the movement of notched roller (12') with respect to the movement of guiding element (6), thereby varying the length of the measured yarn. Such adjustment can also be performed while the loom is working. Locking of the handle (52) allows it to keep in its position once the yarn has been adjusted to the correct length.

It is therefore possible, for example, with a roller of 180 mm diameter, to obtain a variation of the measured length of pick between 220 cm and 180 cm by rotating the roller six times faster than the loom, thus obtaining a normal modification of the weaving length without having to change the speed of the measuring device.

The present invention is not limited to the embodiments provided above and covers any modification and alterations that can be brought thereto by one skilled in the art. For example, it would be possible to apply the invention to measuring devices with other than cylindrical rollers. For example, to measuring devices with conical rollers. Moreover, the shape of the notches produced on one of the rollers, in order to vary the gripping length, can be adapted as a function of the working conditions. Additionally, if the in and out movement of the guiding elements (6, 6') is fast, the sawtooth configuration of the notches shown in FIG. 4 can be replaced by rectangular-shaped notches.

Figure 7:
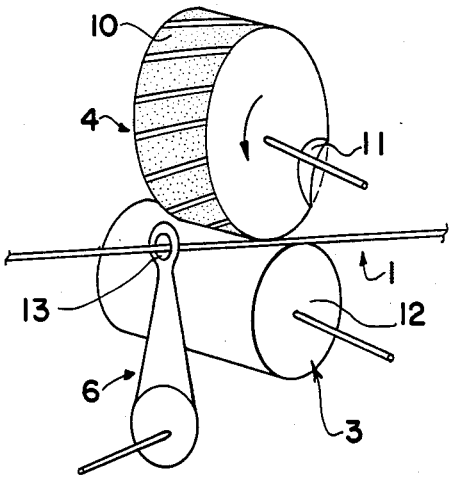
FIG. 7 illustrates a measuring device according to the present invention having a single alveolus and an elastic surface coating.

Further, it is possible to use only one roller for two guiding elements by providing notches on each side of the roller, the notches being preferably locate on the driving roller to prevent risks of slipping and inaccuracy of measurement, as shown in FIG. 7.

Also, to avoid sudden start of the yarns, it is possible to provide on the edge defining the increasing gripping line, namely the edge catching the yarn, a slight bevel (27) on the periphery (26) of the roller.

Figure 8:
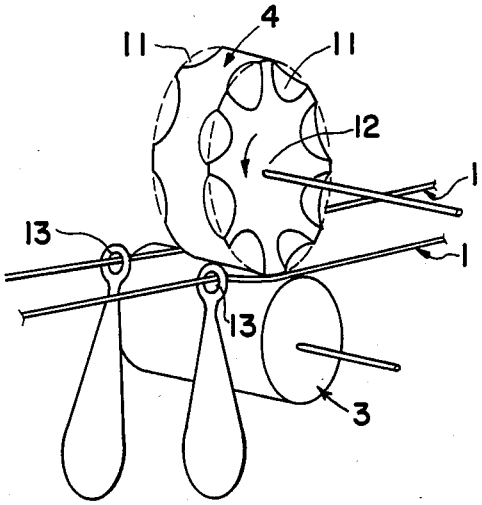
FIG. 8 illustrates a measuring device according to the present invention having alveoli on both sides of a single roller serving two guiding elements.

Finally, the surface of at least one of the rollers forming the gripping line will be preferably coated with an adhesive or an elastic layer, as shown in FIG. 8.

What is claimed is:

1. A weft measuring device for weaving looms, comprising:

a guiding element for guiding a weft yarn;

a pair of rotationally driven propelling rollers disposed adjacent one another and forming a gripping line therebetween into which said guiding element intermittently introduces the weft yarn;

means for actuating said guiding element to guide said weft yarn intermittently into and out of said gripping line in regular and synchronous relation to a weft casting program of the loom; and wherein at least one of said rollers is provided with means for moving an end of the gripping line toward which the weft yarn is conveyed at the start of a measurement cycle regularly and synchronously in cycle with the loom.

2. A weft measuring device as claimed in claim 1, further comprising means for regularly and synchronously varying the length of the gripping line on a large part of the circumference of at least one of said rollers, said means comprising at least one first alveolus formed on a side of at least one said roller where said yarn is inserted into said gripping line.

3. A weft measuring device as claimed in claim 2, further comprising:

a second guiding element for guiding weft yarn into said gripping line;

at least one second alveolus on a side of the roller having said first alveolus opposite to said first alveolus; and means for moving said second guiding element regularly and synchronously with the cycle of the loom to guide a weft yarn into and out of the guiding line at said second alveolus.

4. A weft measuring device as claimed in claim 2, wherein the roller with said alveolus is provided with only one alveolus which determines a length of the gripping line and makes a whole number of rotations during each cycle of the loom.

5. A weft measuring device as claimed in claim 2, wherein the one of said rollers with said at least one alveolus has a number N of alveoli arranged in angularly equal distribution, said roller with said at least one alveolus making 1/N rotations during each cycle of the loom, N being a whole number.

6. A weft measuring device as claimed in claim 2, wherein the roller provided with alveoli can be angularly offset with respect to the cycle of the guiding element.

7. A weft measuring device as claimed in claim 1, wherein the end of the gripping line moves faster in one direction than in the other.

8. A weft measuring device as claimed in claim 7, wherein the means for moving the gripping line moves the end of the gripping line more rapidly towards the outside than towards the inside.

9. A weft measuring device as claimed in claim 7, wherein the means for actuating the guiding element moves the yarn guiding element faster in one direction into and out of the gripping line than in the other.

10. A weft meaasuring device as claimed in claim 7, further comprising means for conjugating the speed of displacement of the gripping line and the speed of the guiding element.

11. A weft measuring device as claimed in claim 1, wherein said alveolus comprises a face essentially constituted by a helical surface and a substantially axial plane.

12. Weft measuring device as claimed in claim 11, wherein an edge between the axial plane and the periphery of the roller has a slightly rounded portion followed by a slight bevel.

13. A weft measuring device as claimed in claim 1, wherein further comprising a planetary gear system for driving the weaving loom and allowing offset movement of said rollers with respect to that of the loom.

14. A weft measuring device as claimed in claim 1, wherein at least one of the rollers is coated with an elastic layer.

* * * * *